US006643474B2

(12) United States Patent
Kodama et al.

(10) Patent No.: US 6,643,474 B2
(45) Date of Patent: Nov. 4, 2003

(54) ABNORMALITY DISPLAYING APPARATUS FOR USE IN IMAGE FORMING APPARATUS

(75) Inventors: Naoki Kodama, Yamatokoriyama (JP); Takashi Nakagawa, Nara (JP); Shinji Kato, Osaka (JP); Tuyoshi Higaki, Yamatokoriyama (JP); Hiroshi Maeda, Nara (JP); Kaori Mori, Yasu-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/891,060

(22) Filed: Jun. 25, 2001

(65) Prior Publication Data

US 2002/0009302 A1 Jan. 24, 2002

(30) Foreign Application Priority Data

Jun. 26, 2000 (JP) ..... 2000-191635

(51) Int. Cl.[7] ..... G03G 15/00
(52) U.S. Cl. ..... 399/21; 399/81
(58) Field of Search ..... 399/8, 9, 11, 12, 399/18, 21, 361, 381, 388, 397, 400, 81

(56) References Cited

U.S. PATENT DOCUMENTS 4,062,061 A * 12/1977 Batchelor et al. ..... 399/8 X
4,908,655 A * 3/1990 Takagi ..... 399/21 X
5,583,617 A * 12/1996 Altrieth, III et al. ..... 399/81
5,790,916 A * 8/1998 Sawada ..... 399/21

FOREIGN PATENT DOCUMENTS

JP 41-79654 6/1992
JP 08-245062 9/1996

* cited by examiner

*Primary Examiner*—Hoan Tran
(74) *Attorney, Agent, or Firm*—David G. Conlin; William J. Daley, Jr.; Edwards & Angell, LLP

(57) ABSTRACT

It is an object of the invention to enable a maintenance work to be executed with appropriate timing. When jam occurrence is detected by jam sensors placed in a plurality of positions in a sheet transporting path, a control section changes a display state such as a shape and a blinking period of a mark in a display section, in accordance with history information which is stored in a storage section. When the display contents of the display section is visually checked, the part where the jam has occurred can be identified from the display position of the mark, and the jam occurrence history in the part can be known from the shape and the blinking period of the mark. Therefore, it is possible to correctly judge the necessity of a maintenance work.

7 Claims, 7 Drawing Sheets

FIG. 7

| JAM OCCURRENCES NUMBER IS EQUAL TO OR LARGER THAN PREDETERMINED NUMBER | JAM RATE IS EQUAL TO OR LARGER THAN PREDETERMINED VALUE | JAM MARK | BLINK |
|---|---|---|---|
| YES | YES | ! | DONE |
| YES | NO | ! | NOT DONE |
| NO | YES | ▼ | DONE |
| NO | NO | ▼ | NOT DONE |

ABNORMALITY DISPLAYING APPARATUS FOR USE IN IMAGE FORMING APPARATUS

BACKGROUND OF THE INVENTION

1. Field of the Invention

The present invention relates to an abnormality displaying apparatus for an image forming apparatus such as a copier, and particularly to an abnormality displaying apparatus for an image forming apparatus which displays that an abnormality has occurred in any part of a sheet transporting path for transporting sheets such as printing sheets.

2. Description of the Related Art

Conventionally, in some of image forming apparatuses such as a copier, when an abnormality such as a jam has occurred in any part of a sheet transporting path, the part where the abnormality has occurred is displayed on display means such as a display apparatus in an operation panel.

For example, Japanese Unexamined Patent Publication JP-A 8-245062 (1996) discloses a configuration in which, when a jam has occurred in any part of a sheet transporting path, a recording operation and an operation of transporting sheets are stopped, and the occurrence of the jam and the part of the occurrence are displayed.

Japanese Unexamined Patent Publication JP-A 4-179654 (1992) discloses a configuration in which occurrence frequency of jams in each jamming point is numerically displayed and whether an abnormality has occurred in an apparatus is judged based on the occurrence frequency.

In this way, objects whose abnormality during transportation is displayed embrace all kinds of sheets which are to be transported in an image forming apparatus, including not only printing sheets but also original sheets and the like.

In order to perform maintenance such as part replacement or adjustment in a copier with appropriate timing, it is required to know history of abnormality occurrence states such as the occurrence frequency of jams in each jamming part and the total number of jam occurrences.

In the above-mentioned conventional art, the part where a jam has occurred or the occurrence frequency of jams is displayed, however, the display state is free from the occurrence history of jams. Accordingly in actual maintenance, a service man must check the operation status, e.g., in a simulation mode, or obtain jam information from an external terminal. As a result, it is difficult to carry out an inspection with inappropriate timing.

SUMMARY OF THE INVENTION

It is an object of the invention to provide an abnormality displaying apparatus for use in an image forming apparatus, useful for performing maintenance of the image forming apparatus with appropriate timing.

The invention comprises the following components as means for solving the problem.

The invention provides an abnormality displaying apparatus for use in an image forming apparatus, in which occurrence of an abnormality in any part of a sheet transporting path is detected and in which part of the sheet transporting path the abnormality has occurred is displayed, the abnormality displaying apparatus comprising:

display means for displaying the part of the sheet transporting path where the detected abnormality has occurred; and control means for changing a display state of the display means in accordance with an occurrence status of the abnormality in the part of the sheet transporting path.

According to the invention, when an abnormality has occurred in any part of the sheet transporting path, the part where the abnormality has occurred is displayed on the display means in a display state which is different in accordance with an occurrence status of the abnormality in the part. Therefore, the part where the abnormality has occurred can be identified based on the display contents of the display means, and the occurrence status of the abnormality in the part can be known.

According to the invention, when an abnormality has occurred in any part of the sheet transporting path, the part where the abnormality has occurred is displayed on the display means in a display state which is different in accordance with an occurrence status of an abnormality in the part, whereby the part where the abnormality has occurred can be identified based on display contents on the display means, and the occurrence status of the abnormality in the part can be known. As a result, it is possible to easily judge whether a maintenance work is required or not, whereby a maintenance work can be performed with appropriate timing. Accordingly, the occurrence frequency of jams can be reduced and reduction of the running cost can be realized.

In the invention it is preferable that the abnormality displaying apparatus further comprises storage means for storing history information with respect to abnormality occurrence states in each of a plurality of parts of the sheet transporting path, and the control means changes the display state of the display means in accordance with the history information stored in the storage means.

According to the invention, when an abnormality has occurred in any part of the sheet transporting path, the abnormality occurrence status is stored in the storage means as history information, and the part where the abnormality has occurred is displayed on the display means in a display state corresponding to the history information in the storage means. Therefore, the part where the abnormality has occurred can be identified on the basis of the display state of the display means, and the history information relating to occurrence of an abnormality in the part is known as a factor for judging the necessity of a maintenance work.

According to the invention, when an abnormality has occurred in any part of the sheet transporting path, the state of abnormality occurrence can be stored in the storage means as history information, and the part where the abnormality has occurred can be displayed on the display means in a display state which is changed according to the history information in the storage means. When the display contents of the display means is visually checked, therefore, the part where the abnormality has occurred can be identified, and the history information relating to occurrence of an abnormality in the part can be easily known as a factor for judging the necessity of a maintenance work.

In the invention, it is preferable that the control means blinks a mark indicating the part where the abnormality has occurred.

In the invention, it is preferable that the control means changes a blinking period pattern of the mark in accordance with history information with respect to the part where the abnormality has occurred, the history information being stored in the storage means.

According to the invention, the mark indicative of the part where the abnormality has occurred is blinkingly displayed on the display means. Therefore, the part where the abnormality has occurred can be identified by the mark displayed on the display means.

According to the invention, the mark indicative of the part where the abnormality has occurred is blinkingly displayed on the display means at a period pattern according to history information which relates to abnormality occurrence in the part. Therefore, history information relating to abnormality occurrence in the part can be known from the period pattern at which the mark blinks.

According to the invention, the mark indicative of the part where the abnormality has occurred is blinkingly displayed on the display means, so that the part where the abnormality has occurred can be identified by the mark displayed on the display means.

According to the invention, the mark indicative of the part where the abnormality has occurred is blinkingly displayed on the display means at a period pattern according to history information which relates to abnormality occurrence in the part, so that history information relating to abnormality occurrence in the part can be promptly known from the blinking state of the mark.

In the invention, it is preferable that the control means changes a shape of the mark in accordance with the history information with respect to the part where the abnormality has occurred, the history information being stored in the storage means.

According to the invention, the mark indicative of the part where the abnormality has occurred is displayed on the display means in a shape according to history information which relates to abnormality occurrence in the part. Therefore, the part where the abnormality has occurred is identified by the mark displayed on the display means, and history information relating to abnormality occurrence in the part is known from the shape of the displayed mark.

According to the invention, the mark indicative of the part where the abnormality has occurred is displayed on the display means in a shape according to history information which relates to abnormality occurrence in the part, so that the part where the abnormality has occurred can be identified by the mark displayed on the display means, and history information relating to abnormality occurrence in the part can be promptly known from the shape of the displayed mark.

BRIEF DESCRIPTION OF THE DRAWINGS

Other and further objects, features, and advantages of the invention will be more explicit from the following detailed description taken with reference to the drawings wherein:

FIG. 7 is a table showing correspondence relationships between abnormality displaying conditions and a mark display state.

DETAILED DESCRIPTION OF THE PREFERRED EMBODIMENTS

Figure 1:
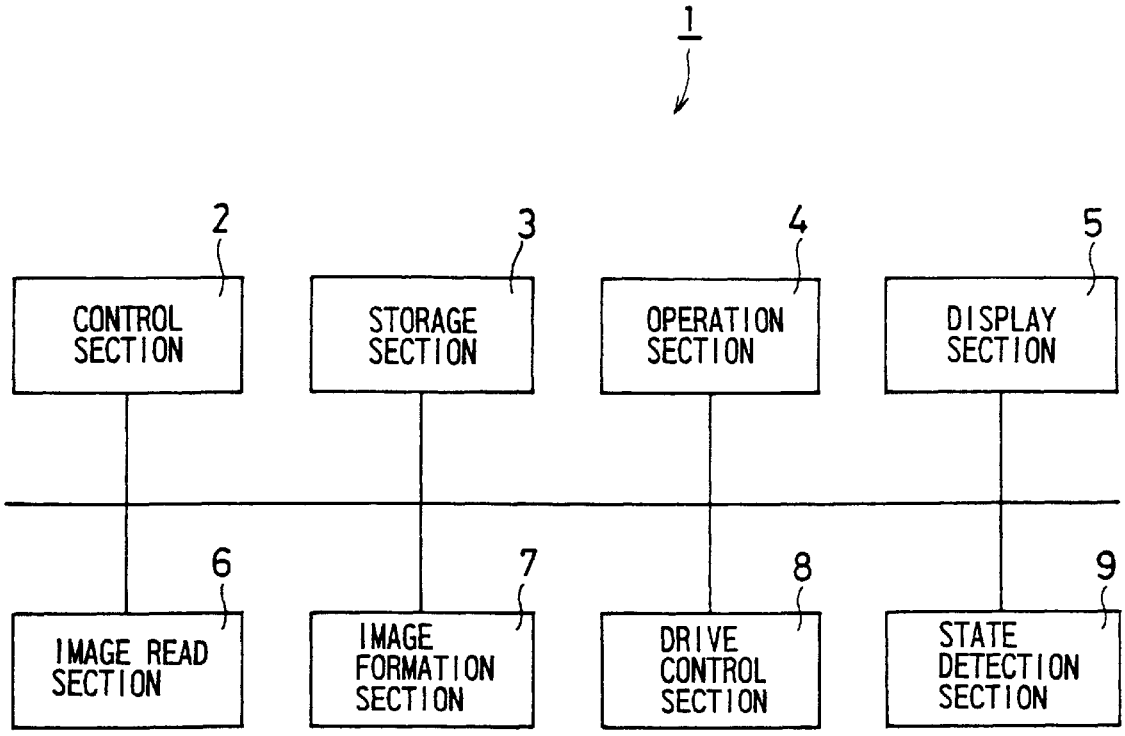
FIG. 1 is a block diagram of a copier to which an abnormality displaying apparatus of an embodiment of the invention is applied.

Now referring to the drawings, preferred embodiments of the invention are described below.

FIG. 1 is a block diagram of an abnormality displaying apparatus of an embodiment of the invention which is applied to an imaging forming apparatus. A copier 1 which is an imaging forming apparatus comprises: a control section 2 which controls operations of various sections; a storage section 3 which stores predetermined information; an operation section 4 through which manual operations are input; a display section 5 which performs a displaying operation on a screen in accordance with operation states of various sections; an image read section 6 which reads an image of an original sheet that is set on an original table; an image formation section 7 which forms an image on a sheet fed to a predetermined part; a drive control section 8 which performs controls on various sections, including the driving control of motors for driving an optical system and a main motor that are disposed in the image read section 6 and the image formation section 7, and the power supply control on a charging charger, a transfer charger, and the like; and a state detection section 9 which detects operation states of predetermined portions.

The control section 2 corresponds to control means in the invention, generally controls various sections, displays the part where a jam has occurred in a sheet transporting path, and blinks marks M (FIGS. 6A to 6C) which are different from one another in accordance with history information relating to jam occurrence in the part where a jam has occurred (jam occurrence history information).

The storage section 3 corresponds to storage means in the invention, and has storage regions which store jam occurrence history information as described later. In the operation section 4, switches including a copy start switch which is operated when a copying operation is to be started, and ten keys through which an operation of inputting the number of copies or the like are disposed. The state detection section 9 has jam sensors 9*a,* 9*b,* and 9*c* which detect occurrence of a jam of a sheet in the sheet transporting path. The jam sensors 9*a,* 9*b,* and 9*c* are positioned in predetermined parts in the sheet transporting path as described later.

Figure 2:
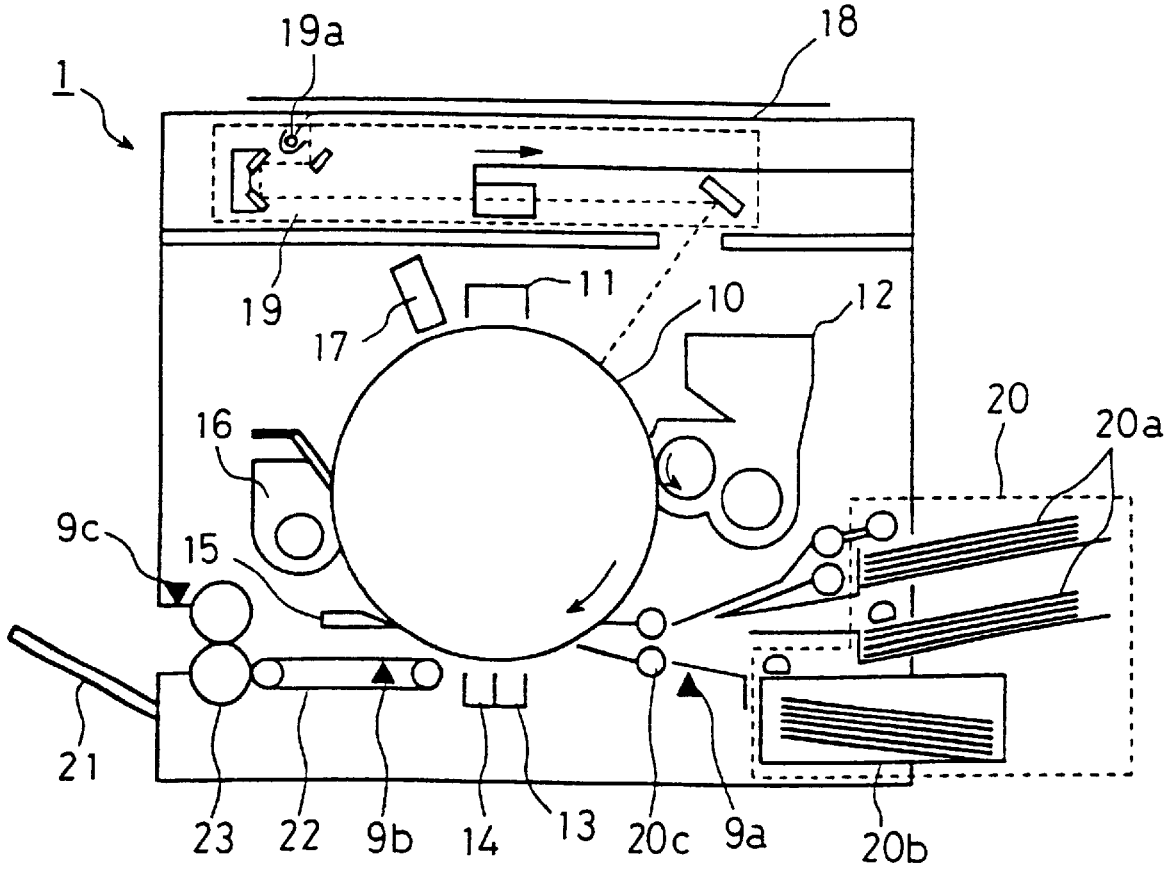
FIG. 2 is a schematic section view of the copier.

FIG. 2 is a schematic section view of the copier 1. Around a photoconductor drum 10, the charging charger 11 which charges the surface of the photoconductor drum 10 to a given potential, a developing apparatus 12 which develops an electrostatic latent image formed on the surface of the photoconductor drum 10 into a toner image, the transfer charger 13 which transfers the developed toner image to a sheet, a separation charger 14 and a separation pawl 15 that separate the sheet to which the toner image has been transferred from the photoconductor drum 10, a cleaner 16 which removes away untransferred toner on the surface of the photoconductor drum 10, and a discharge lamp 17 which discharges the surface of the photoconductor drum 10 are arranged in this sequence.

The optical system 19 which reads an image of an original sheet that is set on the original table 18 is placed above the photoconductor drum 10. The optical system 19 exposure-scans the original sheet by light from a light source 19*a,* and guides reflected light from the image face of the original sheet to the surface of the photoconductor drum 10, thereby forming an electrostatic latent image based on the original image on the surface of the photoconductor drum 10.

A sheet feed section 20 in which sheets are to be set and a manual feed tray 20*a* and a sheet cassette 20*b* are placed is disposed on a right side of the photoconductor drum 10 in FIG. 2. A sheet discharge tray 21 onto which a sheet bearing a transferred image is to be discharged is disposed on a left side of the photoconductor drum 10 in FIG. 2. A PS roller

20*c* which guides a sheet fed from the sheet feed section 20, between the photoconductor drum 10 and the transfer charger 13 with a timing synchronized with rotation of the photoconductor drum 10, and a transport section 22 which transports a sheet that has undergone the transfer operation, toward a fixing roller 23 are arranged in the main unit of the copier 1.

The first jam sensor 9*a* is placed upstream from (in front of) the PS roller 20*c* in the sheet transporting direction, the second jam sensor 9*b* is placed downstream from (in rear of) the separation charger 14 in the sheet transporting direction, and the third jam sensor 9*c* is placed downstream from the fixing roller 23 in the sheet transporting direction.

The jam sensors 9*a,* 9*b,* and 9*c* are configured by, for example, limit switches, and detect the sheet passing status in the three parts. Namely, the first jam sensor 9*a* detects occurrence of a jam in the vicinity of the sheet feed section 20 in the sheet transporting path, the second jam sensor 9*b* detects occurrence of a jam in the vicinity of the transferring position, and the third jam sensor 9*c* detects occurrence of a jam in the vicinity of the fixing roller. Of course, the jam sensors 9*a,* 9*b,* and 9*c* may be replaced with optical sensors or the like.

Figure 3:
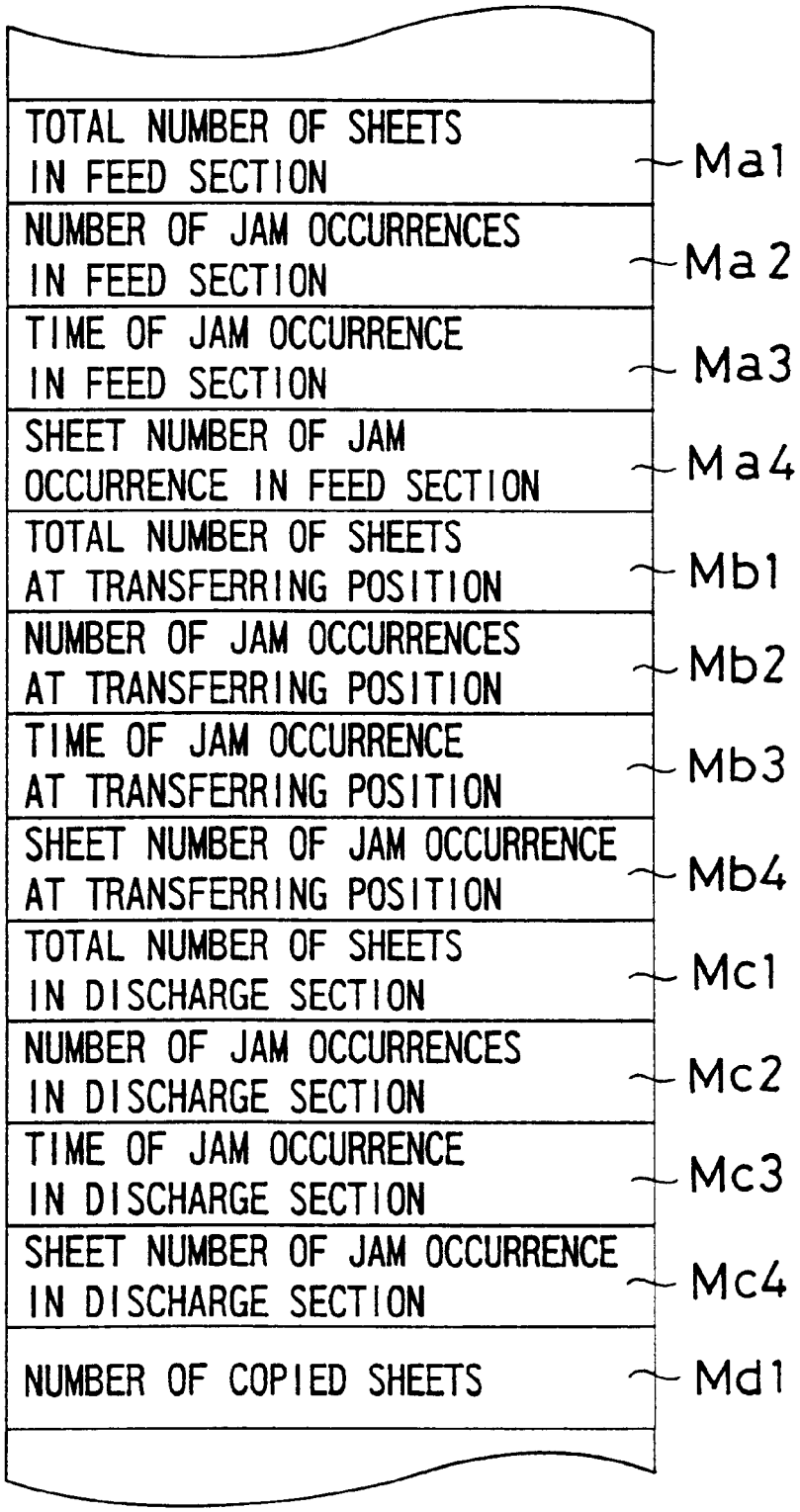
FIG. 3 is a diagram of storage areas of jam occurrence history information in a storage section of the copier.

FIG. 3 is a memory map showing the configuration of storage areas in the storage section of the copier. In order to store history information of occurrence of an abnormality such as a jam in each of the three parts in the vicinities of the sheet feed section, the transferring position, and the sheet discharge section, total sheets number storage areas Ma1, Mb1, and Mc1, jam occurrences number storage areas Ma2, Mb2, and Mc2, jam occurrence time storage areas Ma3, Mb3, and Mc3, and jam occurrence sheet number storage areas Ma4, Mb4, and Mc4 are allocated together with a copied sheets number storage area Md1, in the storage section 3.

The total sheets number storage areas Ma1, Mb1, and Mc1 are areas for counting the number of fed sheets. The counter value is incremented each time when a sheet is fed. When a jam has occurred in the vicinity of the sheet feed section, the counter value of the feed section total sheets number storage area Ma1 is incremented, but the counter values of the total sheets number storage area Mb1 of the transferring position and the total sheets number storage area Mc1 of the discharge section are not incremented.

The jam occurrences number storage areas Ma2, Mb2, and Mc2 are areas for counting the number of jams which occurred in corresponding parts. The counter value is incremented each time when a jam occurs. When the counted values C2 of the jam occurrences number storage areas Ma2, Mb2, and Mc2 are respectively divided by the counted values C1 of the total sheets number storage areas Ma1, Mb1, and Mc1, the jam occurrence rates in the respective parts can be calculated (jam occurrence rate=counted value C2/counted value C1).

With respect to each of the total sheets number storage areas Ma1, Mb1, and Mc1, when a jam has occurred upstream from the corresponding abnormality detection part and a sheet is not fed to the part, the counted value is not incremented. Therefore, the jam occurrence rate can be correctly calculated.

The occurrence time storage areas Ma3, Mb3, and Mc3 are areas for storing a time when a jam has occurred. When a jam occurs in the corresponding part, the occurrence time is stored. In the occurrence time storage areas Ma3, Mb3, and Mc3, not only a region for storing the time of the present jam occurrence, but also a region for storing the time of the previous jam occurrence are disposed, so that it is possible to know the time elapsed after the previous jam occurrence and before the present jam occurrence.

The jam occurrence sheet number storage areas Ma4, Mb4, and Mc4 are areas for storing the number of sheets which have been sent before a jam occurs in the corresponding part, and, when a jam occurs, additively store the counted values of the total sheets number storage areas Ma1, Mb1, and Mc1. Therefore, the jam occurrence sheet number storage areas Ma4, Mb4, and Mc4 store not only the total sheets number at the time of the present jam occurrence, but also the number of sheets which have passed through the part after the previous jam occurrence and before the present jam occurrence.

The stored contents of the total sheets number storage areas Ma1, Mb1, and Mc1, the jam occurrences number storage areas Ma2, Mb2, and Mc2, the occurrence time storage areas Ma3, Mb3, and Mc3, and the jam occurrence sheet number storage areas Ma4, Mb4, and Mc4 are cleared with appropriate timing such as (1) when maintenance of the whole copier is completed, (2) when the number of copied sheets reaches a preset value, or (3) when a jam does not occur during operations of copying a preset number of sheets, or during a preset time period.

In the storage section 3, the copied sheets number storage area Md1 for counting the number of sheets which are discharged onto the sheet discharge tray 21, i.e., the number of sheets which have undergone the copying process without causing a jam is further disposed.

Figure 4:
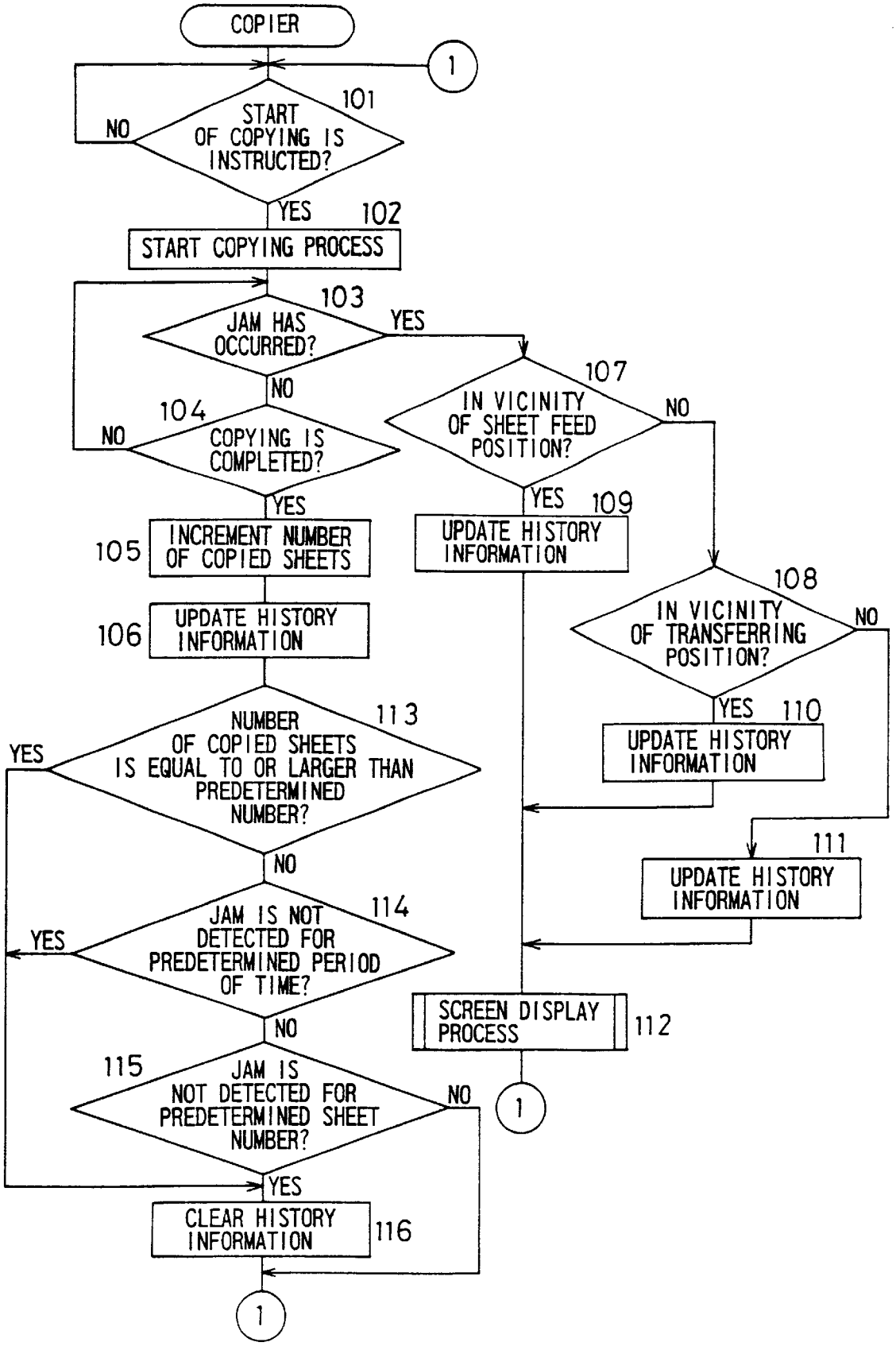
FIG. 4 is a flowchart showing the operation of the copier.

FIG. 4 is a flowchart showing the procedure in the control section 2 of the copier in the case where a jam occurs. When instructions for executing a copying process are given (step 101), the control section 2 starts (executes) the copying process (step 102). The instructions for executing the copying process are given by operating a copy key disposed in the operation section 4.

The control section 2 judges whether a jam has occurred or not, from the jam sensors 9*a,* 9*b,* and 9*c* which respectively correspond to the three parts in the vicinities of the sheet feed section, the transferring position, and the sheet discharge section (the fixing roller) (step 103). If a jam does not occur, the control section 2 continues the judgement until the copying process is completed (step 104).

When the copying process is completed, the control section 2 increments the number of copied sheets which is stored in the copied sheets number storage area Md1 of the storage section 3 (step 105). The control section 2 updates the jam occurrence history information in each of the parts in the vicinities of the sheet feed section, the transferring position, and the sheet discharge section (step 106). In this process, the control section 2 increments the counted values of the total sheets number storage areas Ma1, Mb1, and Mc1, and calculates the jam occurrence rate. Thereafter, the control proceeds to step 113.

When a jam occurs during the copying process, the control section 2 judges in which part a jam has occurred among the vicinities of the sheet feed section, the transferring position, and the sheet discharge section (steps 107 and 108).

When the jam sensor 9*a* fails to detect a passage of a sheet fed from the sheet feed section 20, the control section 2 judges that a jam has occurred in the vicinity of the sheet feed section. When the jam sensor 9*b* fails to detect a passage of a sheet during a predetermined period of time after the jam sensor 9*a* detects a passage of the sheet, the control section 2 judges that a jam has occurred in the vicinity of the transferring position. When the jam sensor 9*c* fails to detect a passage of a sheet during a predetermined period of time after the jam sensor 9*b* detects a passage of the sheet, the control section 2 judges that a jam has occurred in the vicinity of the fixing roller.

First, if the part where a jam has occurred is in the vicinity of the sheet feed section, the control section 2 performs the following process of updating the jam occurrence history information (step 109). In this process, the control section 2 increments the counted value of the feed section total sheets number storage area Ma1, and that of the feed section jam occurrences number storage area Ma2. The control section 2 stores the current time into the feed section jam occurrence time storage area Ma3, and the counted value of the feed section total sheets number storage area Ma1 into the feed section jam occurrence sheet number storage area Ma4.

In the feed section jam occurrences number storage area Ma2 and the feed section jam occurrence sheet number storage area Ma4, a previous information storage region for storing the time when the previous jam occurred and the total sheet number is allocated. During the above-mentioned process, the jam occurrence time and the total sheets number which have been stored in the feed section jam occurrence time storage area Ma3 and the feed section jam occurrence sheet number storage area Ma4 before the present jam occurs are stored into the respective previous information storage regions. With respect to the vicinities of the transferring position and the sheet discharge section, the updating process is not performed.

If the part where a jam has occurred is in the vicinity of the transferring position, the control section 2 performs the following process of updating the jam occurrence history information (step 110). In this process, the control section 2 updates jam occurrence history information in the vicinity of the transferring position in the same manner as the above-described updating process in step 109. Specifically, the control section 2 increments the counted value of the transferring position total sheets number storage area Mb1, and that of the transferring position jam occurrences number storage area Mb2. The control section 2 stores the current time into the transferring position jam occurrence time storage area Mb3, and the counted value of the transferring position total sheets number storage area Mb1 into the transferring position jam occurrence sheet number storage area Mb4, and then calculates the jam occurrence rate.

If the part where a jam has occurred is in the vicinity of the sheet discharge section, the control section 2 performs the following process of updating the jam occurrence history information (step 111). In this process also, the control section 2 updates jam occurrence history information in the vicinity of the sheet discharge section in the same manner as the above-described updating process in step 109. Specifically, the control section 2 increments the counted value of the discharge section total sheets number storage area Mc1, and that of the discharge section jam occurrences number storage area Mc2. The control section 2 stores the current time into the discharge section jam occurrence time storage area Mc3, and the counted value of the discharge section total sheets number storage area Mc1 into the discharge section jam occurrence sheet number storage area Mc4, and calculates the jam occurrence rate.

As described above, in accordance with the presence and the part of the occurrence of a jam, the jam occurrence history information updating process of one of steps 106, 109, 110, and 111 is executed.

When the processes of steps 107 to 111 are completed, the control section 2 performs a process of displaying the jam occurrence on the display section 5 (step 112), and the control then returns to step 101. The display process in step 112 will be described later. In the copier 1, immediately after jam occurrence is detected in step 103 and the control section 2 performs the series of processes of steps 107 to 112, the copying process is stopped.

When the history information updating process (step 106) is ended, the control section 2 judges whether the counted value of the copied sheets number storage area Md1 reaches a predetermined value (for example, 1,000 sheets) or not (step 113), whether a jam has not occurred during a predetermined period of time (for example, 10 days) or not (step 114), and whether a jam has not occurred for a number of sheets which is equal to or more than a predetermined number of sheets (for example, 200 sheets) or not (step 115). As described above, information required for the judgements is stored in the storage section 3.

If the counted value of the copied sheets number storage area Md1 reaches the predetermined value, if a jam has not occurred during the predetermined period of time, or if a jam has not occurred for a predetermined number of sheets or more, the control section 2 clears the jam occurrence history information stored in the storage section 3 (step 116), and the control then returns to step 101. In another case, the control returns to step 101 without performing the clearing process.

In the clearing process in step 116, the stored contents of the total sheets number storage areas Ma1, Mb1, and Mc1, the jam occurrences number storage areas Ma2, Mb2, and Mc2, the jam occurrence time storage areas Ma3, Mb3, and Mc3, the jam occurrence sheet number storage areas Ma4, Mb4, and Mc4, and the copied sheets number storage area Md1 are cleared away.

As described above, the jam occurrence history information is cleared with appropriate timing. Therefore, the old history is not used in calculation of the jam occurrence rate, and the like, so that the jam occurrence rate and the like can be always obtained by using appropriate history.

The counted value of the copied sheets number storage area Md1 is used for judging the timing of executing a maintenance work, and usually reset by an operation on a reset switch (not shown) after the maintenance work is completed. Also when the copied sheets number storage area Md1 is reset, the other jam occurrence history information is cleared.

As described above, jam occurrence history information is cleared interlockingly with an operation on the reset switch at completion of a maintenance work. After a maintenance work such as part replacement is performed, therefore, jam occurrence history information before the maintenance work is not used in calculation of the jam occurrence rate.

Figure 5:
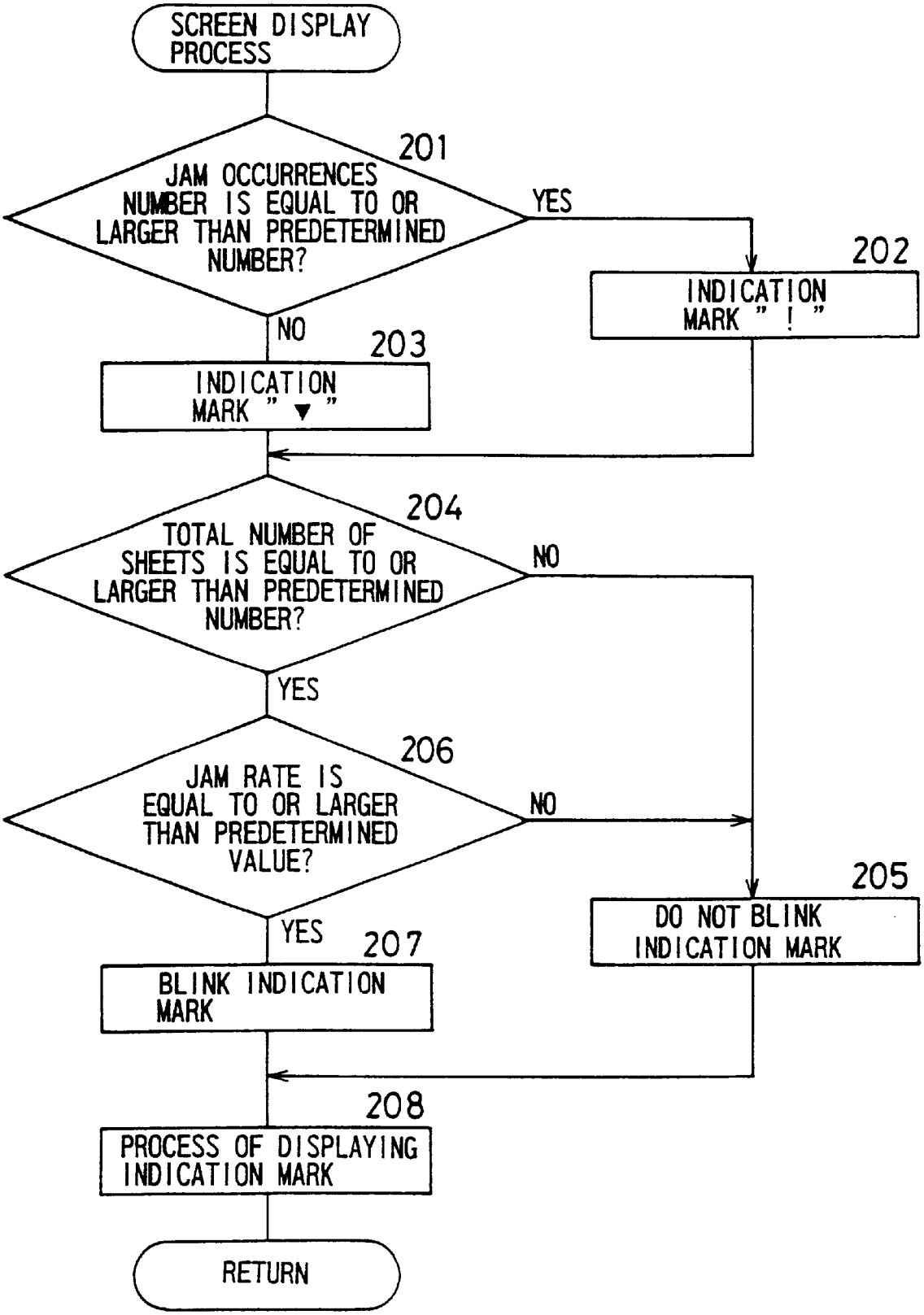
FIG. 5 is a flowchart showing a subroutine of a screen display process of FIG. 4.

FIG. 5 is a flowchart showing the procedure of the screen display process of FIG. 4. Using the jam occurrence history information relating to the part where the jam has occurred, the control section 2 judges whether a jam occurred in this part a predetermined number of times or more (for example, 30 or more times) or not (step 201). If a jam occurred the predetermined number of times or more, it is appropriate to perform a maintenance work, and hence the control section 2 determines "!" to be displayed as the indication mark on the display section 5 (step 202). If a jam did not occur the predetermined number of times or more (less than the predetermined number of sheets), the control section 2 determines "▼" to be displayed as the indication mark (step 203).

The control section 2 then judges whether the counted values of the total sheets number storage areas Ma1, Mb1, and Mc1 are equal to or larger than a predetermined number of sheets (for example, 100 sheets) or not (step 204). In a situation where the sample number (the number of processed sheets) is small from the statistical viewpoint, it is seemed that a correct jam occurrence rate cannot be calculated. If the counted values are smaller than the predetermined number of sheets, therefore, the control section 2 does not blink the mark which is determined in step 202 or 203 (step 205).

If the counted values are not smaller than the predetermined number of sheets, the control section 2 judges whether the jam occurrence rate exceeds a limit value (for example, 10%) or not (step 206). If the jam occurrence rate exceeds the limit value, the control section 2 blink the mark which is determined in step 202 or 203 (step 207). If the jam occurrence rate does not exceed the limit value, the control section 2 does not blink the mark (step 205).

Moreover, the control section 2 controls the display section 5 so as to display the indication of jam occurrence, and display the mark which is determined in step 202 or 203 in a position of the display screen corresponding to the jam occurrence part, in accordance with the execution of blinking which is determined in step 205 or 207 (step 208).

Figure 6A:
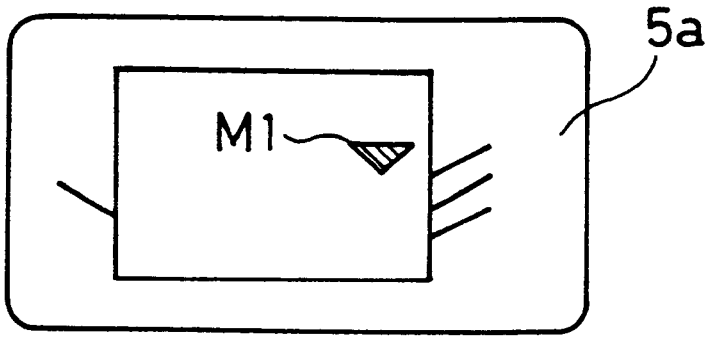
FIGS. 6A to 6C are views illustrating display examples in a display section of the copier.
Figure 6B:
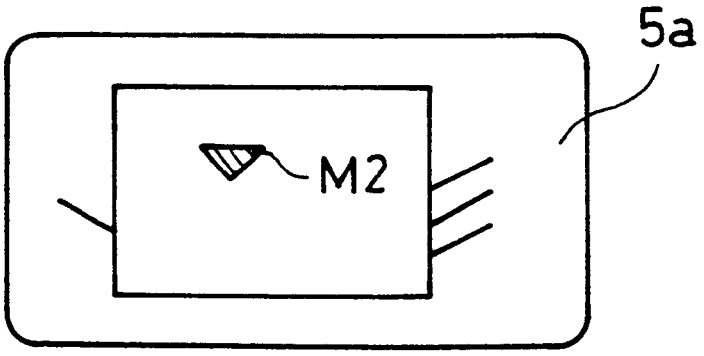
Figure 6C:
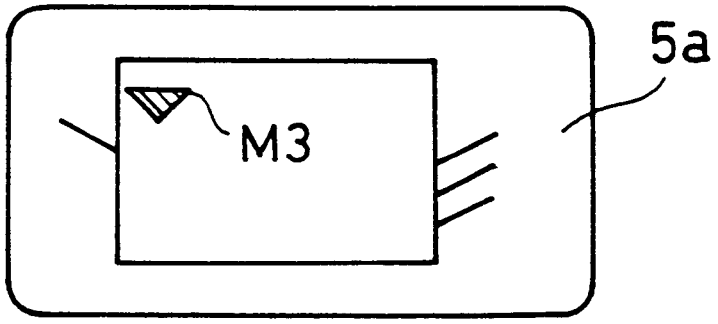

FIGS. 6A to 6C show display examples in the display section 5 in the case where a jam occurs. FIG. 7 is a table showing correspondence relationships between displaying conditions and a mark (jam mark) display state in the case where a jam occurs. In FIGS. 6A to 6C, and 7, a mark M (M1 to M3) is displayed on the screen of the display section 5 in accordance with the part where a jam has occurred.

When a jam occurs in the vicinity of the sheet feed section, the display screen becomes as shown in FIG. 6A. When a jam occurs in the vicinity of the transferring position, the display screen becomes as shown in FIG. 6B. When a jam occurs in the vicinity of the fixing roller, the display screen becomes as shown in FIG. 6C. In each of the screens, the mark which is determined according to the jam occurrence history information is displayed in accordance with the execution of blinking which is determined based on the jam occurrence history information.

When the operator checks the jam occurrence part in order to remove the jammed sheet in the sheet transporting path, therefore, the operator can know the situation of the part (for example, whether a situation where a jam easily has occurred is made or not). As a result, the operator can perform maintenance such as replacement of a deteriorated part, or readjustment with appropriate timing, so that waste consumption of sheets due to occurrence of a jam or like abnormalities and the rising of the running cost can be suppressed.

In the above, the embodiment in which a jam occurrence part is informed by blinking a mark has been described. When the blinking period of the mark is changed in accordance with the jam occurrence history information, the visual distinguishability can be enhanced. The apparatus may be configured so that the state of the whole screen is changed.

The above-described embodiment is configured so that, as abnormality occurrence, occurrence of a jam in the sheet transporting path is displayed on the screen of the display section 5. The invention can be applied also to a case where a trouble other than such a jam, for example, a jam of an original sheet in an automatic original feeding apparatus is to be displayed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An abnormality displaying apparatus for use in an image forming apparatus, in which occurrence of an abnormality in any part of a sheet transporting path is detected and in which the part of the sheet transporting path the abnormality has occurred is displayed, the abnormality displaying apparatus comprising:

display means for displaying the part of the sheet transporting path where the detected abnormality has occurred;

control means for changing a display state representative of the part being displayed by the display means in accordance with an occurrence status of the abnormality in the part of the sheet transporting path;

storage means for storing history information with respect to abnormality occurrence states in each of a plurality of parts of the sheet transporting path, where the control means changes the display state representative of the part being displayed by the display means in accordance with the history information stored in the storage means; and wherein the control means blinks a mark indicating the part where the abnormality has occurred and changes a blinking period pattern of the mark in accordance with history information stored in the storage means with respect to the part where the abnormality has occurred.

2. An abnormality displaying apparatus for use in an image forming apparatus, in which occurrence of an abnormality in any part of a sheet transporting path is detected and in which the part of the sheet transporting path the abnormality has occurred is displayed, the abnormality displaying apparatus comprising:

display means for displaying the part of the sheet transporting path where the detected abnormality has occurred;

control means for changing a display state representative of the part being displayed by the display means in accordance with an occurrence status of the abnormality in the part of the sheet transporting path;

storage means for storing history information with respect to abnormality occurrence states in each of a plurality of parts of the sheet transporting path, where the control means changes the display state representative of the part being displayed by the display means in accordance with the history information stored in the storage means; and wherein the control means changes a shape of the mark in accordance with the history information with respect to the part where the abnormality has occurred, the history information being stored in the storage means.

3. An abnormality displaying apparatus for use in an image forming apparatus, in which occurrence of an abnormality in any part of a sheet transporting path is detected and in which the part of the sheet transporting path the abnormality has occurred is displayed, the abnormality displaying apparatus comprising:

display means for displaying the part of the sheet transporting path where the detected abnormality has occurred;

control means for changing a display state of the part being displayed by the display means in accordance with an occurrence status of the abnormality in the part of the sheet transporting path;

wherein the control means changes the display state of the part being displayed by the display means based on one of the number of jam occurrences or a jam rate for the part where the detected abnormality has occurred; and wherein the control means blinks a mark indicating the part where the abnormality has occurred and changes a blinking period pattern of the mark when the jam rate for the part where the detected abnormality has occurred is at least equal to a predetermined value.

4. An abnormality displaying apparatus for use in an image forming apparatus, in which occurrence of an abnormality in any part of a sheet transporting path is detected and in which the part of the sheet transporting path the abnormality has occurred is displayed, the abnormality displaying apparatus comprising:

display means for displaying the part of the sheet transporting path where the detected abnormality has occurred;

control means for changing a display state of the part being displayed by the display means in accordance with an occurrence status of the abnormality in the part of the sheet transporting path, wherein the control means changes the display state of the part being displayed by the display means based on one of the number of jam occurrences or a jam rate for the part where the detected abnormality has occurred;

storage means for storing history information including the number of jam occurrences, the jam rate and a time corresponding to a last jam occurrence for each of said any part of the sheet transporting path;

wherein the control means includes means for updating history information and storing the updated history information in the storage means upon completion of each operational cycle of the image forming apparatus; and wherein the means for updating includes means for clearing history information from the storage means after said clearing means determines that one of another jam has not occurred after a predetermined number of events, relating to each operational cycle of the image forming apparatus, has occurred or after expiration of a predetermined period of time from the time corresponding to the last jam occurrence for said any part of the transporting path stored in the storage means.

5. The abnormality displaying apparatus of claim 4, wherein the clearing means performs said determining after the history information is updated following completion of a latest operational cycle of the image forming apparatus.

6. An abnormality displaying apparatus for use in an image forming apparatus, in which occurrence of an abnormality in any part of a sheet transporting path is detected and in which the part of the sheet transporting path the abnormality has occurred is displayed, the abnormality displaying apparatus comprising:

display means for displaying the part of the sheet transporting path where the detected abnormality has occurred;

control means for changing a display state of the part being displayed by the display means in accordance with an occurrence status of the abnormality in the part of the sheet transporting path, wherein the control means changes the display state of the part being displayed by the display means based on one of the number of jam occurrences or a jam rate for the part where the detected abnormality has occurred;

storage means for storing history information including the number of jam occurrences, the jam rate and a time corresponding to a last jam occurrence for each of said any part of the sheet transporting path;

wherein the control means includes means for updating history information and storing the updated history information in the storage means upon completion of each copying operation of the image forming apparatus; and wherein the means for updating includes means for clearing history information from the storage means after said clearing means determines that one of another jam has not occurred during operation of copying for a predetermined number of sheets, after a total number of copied sheets from a last jam occurrence reaches a predetermined value, or after expiration of a predetermined period of time from the time corresponding to the last jam occurrence for said any part of the transporting path stored in the storage means.

7. The abnormality displaying apparatus of claim 6, wherein the clearing means performs said determining after the history information is updated following completion of a latest copying operation of the image forming apparatus.

* * * * *